US007992978B2

(12) United States Patent
Azami et al.

(10) Patent No.: US 7,992,978 B2
(45) Date of Patent: Aug. 9, 2011

(54) LIQUID EJECTING APPARATUS, LIQUID EJECTING METHOD, AND PROGRAM

(75) Inventors: Nobuaki Azami, Matsumoto (JP); Hirokazu Nunokawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 591 days.

(21) Appl. No.: 12/061,561

(22) Filed: Apr. 2, 2008

(65) Prior Publication Data

US 2008/0246795 A1 Oct. 9, 2008

(30) Foreign Application Priority Data

Apr. 4, 2007 (JP) ..... 2007-098703

(51) Int. Cl.
*B41J 2/175* (2006.01)
*B41J 29/38* (2006.01)

(52) U.S. Cl. ..... 347/85; 347/17; 347/61; 347/66

(58) Field of Classification Search ..... 347/17, 347/61, 66, 85

See application file for complete search history.

(56) References Cited

U.S. PATENT DOCUMENTS

| | | | | |
|---|---|---|---|---|
| 6,213,601 | B1 * | 4/2001 | Akuzawa et al. | 347/89 |
| 2001/0043244 | A1 * | 11/2001 | Sakuma | 347/18 |
| 2005/0053725 | A1 * | 3/2005 | Iwata | 427/375 |
| 2005/0068373 | A1 * | 3/2005 | Yokouchi et al. | 347/56 |
| 2005/0168510 | A1 * | 8/2005 | Asano et al. | 347/17 |

FOREIGN PATENT DOCUMENTS

| | | |
|---|---|---|
| JP | 06-031913 | 2/1994 |
| JP | 07-052409 | 2/1995 |
| JP | 2003-127417 | 5/2003 |
| JP | 2003-220715 | 8/2003 |
| JP | 2004-314346 | 11/2004 |
| JP | 2006-256262 | 9/2006 |
| JP | 2006-281454 | 10/2006 |

* cited by examiner

*Primary Examiner* — Ryan Lepisto
(74) *Attorney, Agent, or Firm* — Workman Nydegger

(57) ABSTRACT

A liquid ejecting apparatus includes a head group having a plurality of heads provided with supply ports for supplying liquid to the heads, the heads being arranged in a nozzle-array direction and ejecting the liquid therefrom to form an image; and a heating portion that heats the liquid to be supplied to the head group, the heating portion being disposed between the supply ports of the heads located at opposite ends in the nozzle-array direction.

8 Claims, 13 Drawing Sheets

LIQUID EJECTING APPARATUS, LIQUID EJECTING METHOD, AND PROGRAM

BACKGROUND

1. Technical Field

The present invention relates to liquid ejecting apparatuses, liquid ejecting methods, and programs.

2. Related Art

Known liquid ejecting apparatuses have a plurality of heads arranged in a sheet-width direction and eject ink droplets from the heads to form images. Since the heads are arranged in the sheet-width direction in such liquid ejecting apparatuses, it is not necessary to move the heads during the image formation process. This implies that an image can be formed on a sheet by simply ejecting ink droplets onto the sheet while transporting the sheet. Accordingly, the image forming rate can be improved.

When ink droplets are ejected by a liquid ejecting apparatus, there are cases where the medium becomes deformed in an area where many ink droplets have landed. Such deformation occurs as a result of the moisture of the ink droplets, and examples of deformation are a cockling phenomenon and a curl phenomenon. In order to reduce the occurrence of such phenomena, high-viscosity ink is used. In the case where high-viscosity ink is used, the ink is heated to lower the viscosity thereof in order to facilitate the ejection of ink droplets from the nozzles of the heads. Examples of liquid ejecting apparatuses that employ high-viscosity ink are disclosed in JP-A-2006-256262 and JP-A-7-52409.

If differences in ink temperature occur among the heads before the heated ink is supplied to the heads, the ink will also vary in viscosity among the heads. Such variations in viscosity lead to differences in the ejectability among the heads, thus causing the ink droplets to vary in size among the heads. This has an adverse effect on the image formation process.

SUMMARY

An advantage of some aspects of the invention is that liquid to be heated and supplied to the heads can have reduced temperature differences among the heads.

A liquid ejecting apparatus according to an aspect of the invention includes a head group having a plurality of heads provided with supply ports for supplying liquid to the heads, the heads being arranged in a nozzle-array direction and ejecting the liquid therefrom to form an image; and a heating portion that heats the liquid to be supplied to the head group, the heating portion being disposed between the supply ports of the heads located at opposite ends in the nozzle-array direction.

Other features of the invention will become apparent from this specification and the attached drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
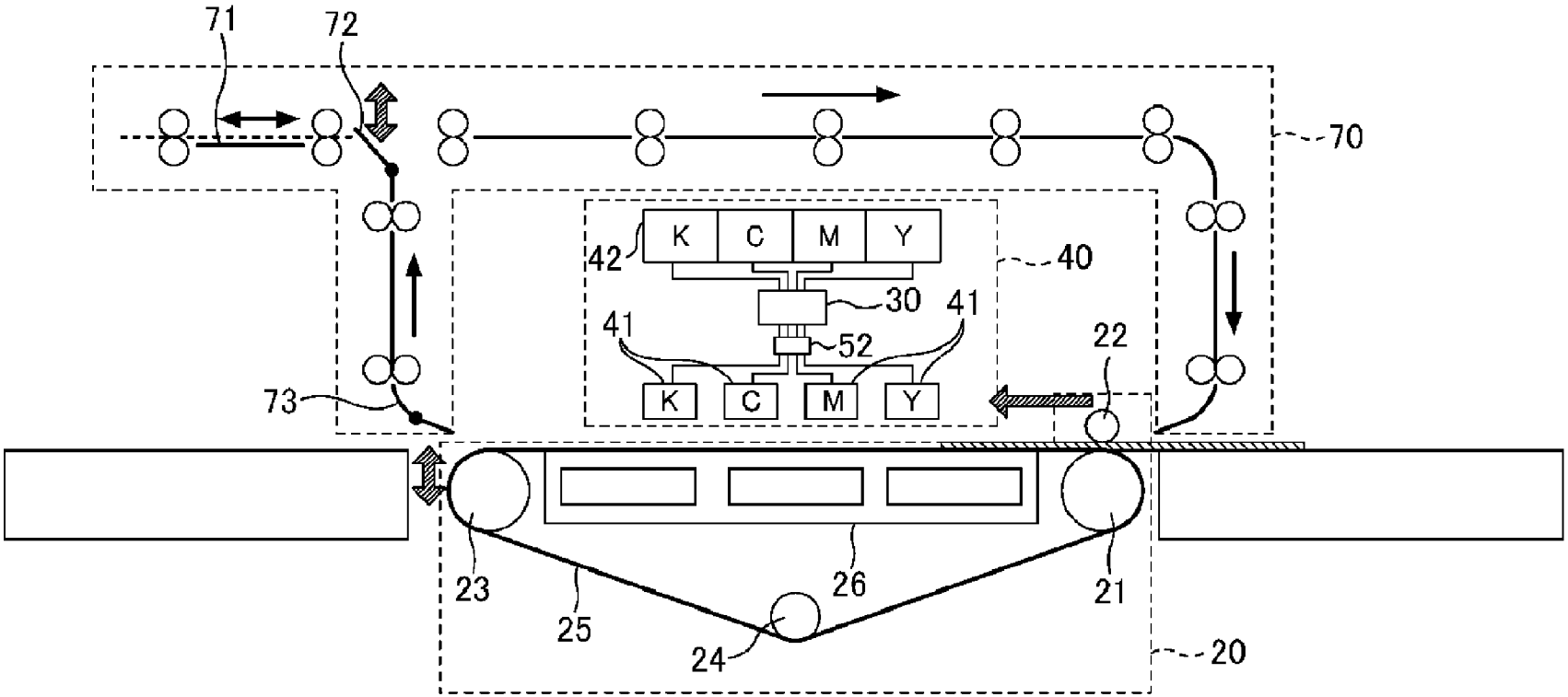
FIG. 1 schematically illustrates the overall configuration of a printer.

At least the following features become apparent from this specification and the attached drawings.

A liquid ejecting apparatus includes a head group having a plurality of heads provided with supply ports for supplying liquid to the heads, the heads being arranged in a nozzle-array direction and ejecting the liquid therefrom to form an image; and a heating portion that heats the liquid to be supplied to the head group, the heating portion being disposed between the supply ports of the heads located at opposite ends in the nozzle-array direction.

Accordingly, the liquid to be heated and supplied to the heads can have reduced temperature differences among the heads.

In the aforementioned liquid ejecting apparatus, it is preferable that the heating portion be disposed at a center position between the supply ports of the opposite-end heads in the nozzle-array direction. It is also preferable that the heating portion be attached to a tube that branches off into branch tubes from the heating portion, the branch tubes supplying the liquid to the heads through the supply ports. It is also preferable that the branch tubes extending from the heating portion to the corresponding heads have the same length. It is also preferable that the heating portion be disposed at a position higher than that of the head group.

Furthermore, it is preferable that the aforementioned liquid ejecting apparatus further include a temperature acquiring portion that acquires temperature information about temperature of the liquid; and a temperature controlling portion that controls the heating portion on the basis of the temperature information so as to control the temperature of the liquid to be supplied to the heads. In this case, it is also preferable that the temperature acquiring portion be attached to a tube located downstream of the heating portion, the tube supplying the liquid to the heads. Moreover, it is preferable that the liquid have a viscosity of 10 mPa·s or higher at 25° C. It is also preferable that the liquid be controlled to a temperature of 30° C. or higher for ejection.

Accordingly, the liquid to be heated and supplied to the heads can have reduced temperature differences among the heads.

A liquid ejecting method includes heating liquid to be supplied to a plurality of heads arranged in a nozzle-array direction, the liquid being heated at a heating portion disposed between liquid supply ports of the heads located at opposite ends of the plurality of heads in the nozzle-array direction; and forming an image by ejecting the liquid from the heads supplied with the liquid.

Accordingly, the liquid to be heated and supplied to the heads can have reduced temperature differences among the heads.

A program allows a liquid ejecting apparatus to perform an operation that includes heating liquid to be supplied to a plurality of heads arranged in a nozzle-array direction, the liquid being heated at a heating portion disposed between liquid supply ports of the heads located at opposite ends of the plurality of heads in the nozzle-array direction; and forming an image by ejecting the liquid from the heads supplied with the liquid.

Accordingly, the liquid to be heated and supplied to the heads can have reduced temperature differences among the heads.

Embodiments

Overall Configuration

Figure 2:
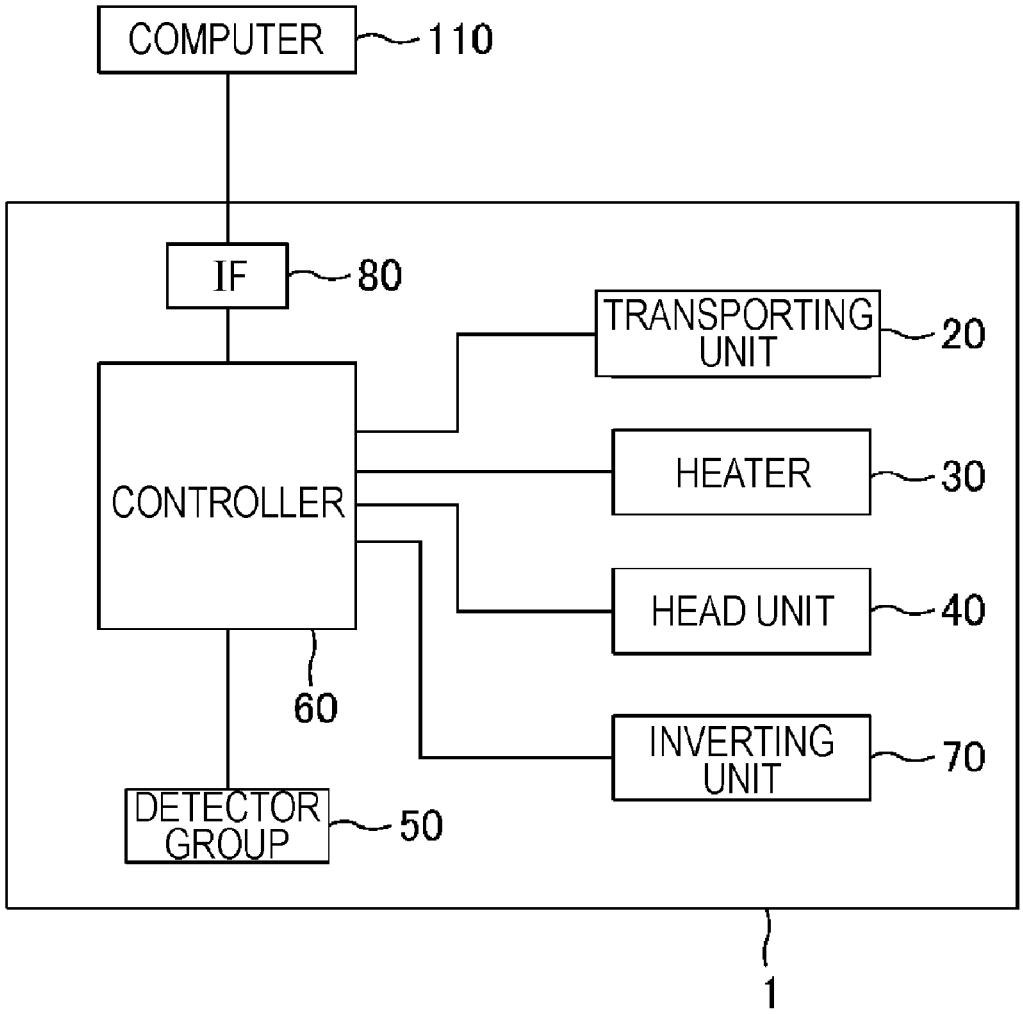
FIG. 2 is a block diagram of the overall configuration of the printer.

FIG. 1 schematically illustrates the overall configuration of a printer 1. FIG. 2 is a block diagram of the overall configuration of the printer 1. The basic configuration of the printer 1 will now be described.

The printer 1 includes a transporting unit 20, a heater 30, a head unit 40, a detector group 50, a controller 60, an inverting unit 70, and an interface 80. The printer 1 receives print data from a computer 110 serving as an external device and allows the controller 60 to control each of the units. In accordance with the control by the controller 60, the printer 1 prints an image on a sheet. The conditions in the printer 1 are monitored by the detector group 50, and the detector group 50 outputs the detection results to the controller 60. Based on the detection results output from the detector group 50, the controller 60 controls the corresponding units.

The transporting unit 20 is provided for transporting a medium such as a sheet S in a predetermined direction (referred to as a transporting direction). The transporting unit 20 includes a driven roller 21, a pressing roller 22, a driving roller 23, a tensioner 24, a belt 25, and a suction unit 26. The driving roller 23 is driven in response to rotation of a driving motor (not shown) controlled by the controller 60. The belt 25 extends around the driving roller 23, the driven roller 21, and the tensioner 24, and thus moves in the transporting direction in response to rotation of the driving roller 23. The tensioner 24 adjusts the tension of the belt 25 to ensure that an appropriate frictional force is generated between the belt 25 and the driving roller 23.

The belt 25 has a predetermined width and can hold thereon a sheet S to transport the sheet S. The belt 25 is provided with evenly distributed holes. The suction unit 26 generates negative pressure to attract the sheet S by suction through these holes in the belt 25. Thus, the sheet S becomes attached onto the belt 25 so as to be transported together with the movement of the belt 25.

The heater 30 is a heating device for heating ink to be supplied to heads, which will be described hereinafter. The heater 30 is connected to the controller 60, and the heating temperature of the heater 30 is adjustable. The heater 30 is attached to ink-supplying tubes to be described hereinafter. By heating the tubes, the ink flowing through the tubes can be heated.

The head unit 40 is provided for ejecting ink droplets toward a sheet S. The head unit 40 includes heads 41 each having a plurality of nozzles. The ink droplets ejected from the head unit 40 are color ink droplets. For example, liquid droplets of yellow Y, magenta M, cyan C, and black B colors can be ejected from the head unit 40. By ejecting these ink droplets, an image can be formed on a sheet S. The arrangement of nozzles in the head unit 40 will be described hereinafter. The head unit 40 also includes an ink tank 42 for storing ink, the heater 30, and a temperature sensor 52. The configuration of these components will also be described hereinafter.

The detector group 50 may be defined by, for example, a rotary encoder attached to the driving roller 23. The output from the rotary encoder is input to the controller 60 and is used for controlling, for example, the transportation of the sheet S. The temperature sensor 52 is also included in this detector group 50. The temperature sensor 52 is attached to tubes serving as ink flow channels at a position downstream of the heater 30, and detects the ink temperature. The temperature sensor 52 is connected to the controller 60 and sends the detected ink temperature to the controller 60.

The controller 60 is a control unit for controlling the printer 1. The controller 60 includes a processor and a memory (not shown). The processor is an arithmetic unit, such as a CPU, for controlling the entire printer 1. The memory has a storage area for storing, for example, data and programs executed by the processor. The processor executes a program stored in the memory so as to allow the controller 60 to control each of the units.

As will be described hereinafter, the controller 60 controls the temperature of the heater 30 so that the ink temperature is adjusted to a target temperature. Heating the ink to an appropriate temperature will lower the viscosity of the ink, whereby ink droplets of an appropriate size can be ejected from the nozzles of the heads 41.

The inverting unit 70 opens and closes open/close gates 72 and 73 to draw a sheet S having an image printed on the front face thereof towards an inverting portion 71. The inverting unit 70 has a function for subsequently transporting and refeeding the same sheet S. In this manner, an image can be printed on the back face of the sheet S.

The interface 80 is, for example, a USB interface connectable to the computer 110. By connecting the interface 80 and the computer 110, print data can be obtained from the computer 110. A description regarding print data will be provided hereinafter. Although the interface 80 is a wired interface in this case, a wireless interface that can perform exchanging of print data may also be used.

The computer 110 generates print data regarding an image to be printed by the printer 1 and outputs the print data. The computer 110 has a printer driver installed therein. When the printer driver receives data of an image to be printed from an application operating on the operating system of the computer 110, the printer driver converts the data to print data required for the printing process, and sends the print data to the printer 1.

Configuration of Heads

Figure 3:
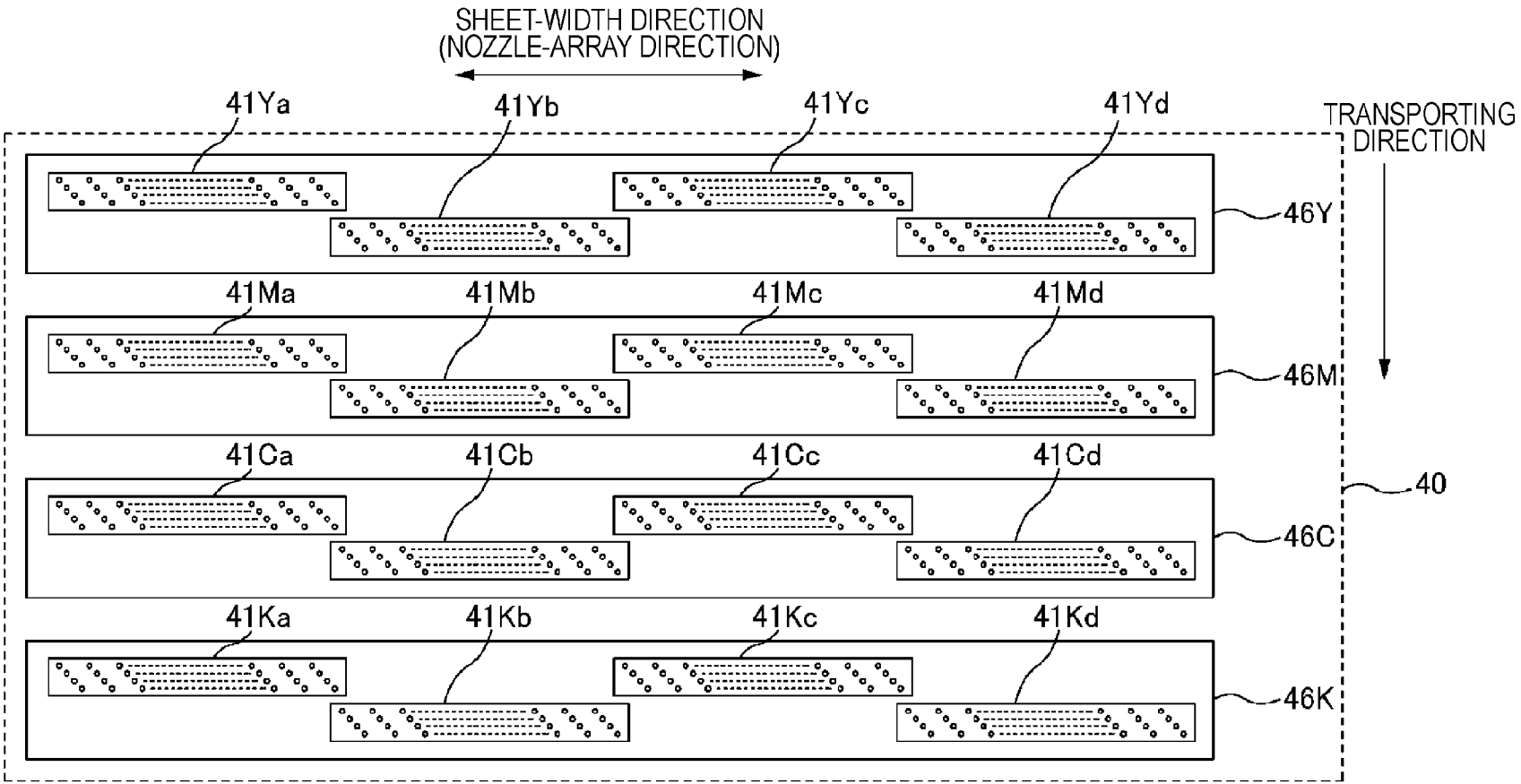
FIG. 3 is a diagram for explaining the arrangement of heads included in a head unit.

FIG. 3 is a diagram for explaining the arrangement of the heads 41 included in the head unit 40. FIG. 3 is shown as viewed from above the printer 1. In actuality, the nozzle holes of the heads 41 are not visible from above due to being covered by other components. However, the nozzle holes in FIG. 3 are shown as viewed from above for the sake of convenience.

The head unit 40 includes four units, namely, a yellow head unit 46Y, a magenta head unit 46M, a cyan head unit 46C, and a black head unit 46K. The yellow head unit 46Y includes four heads 41Ya to 41Yd. Similarly, the magenta head unit 46M includes four heads 41Ma to 41Md, the cyan head unit 46C includes four heads 41Ca to 41Cd, and the black head unit 46K includes four heads 41Ka to 41Kd. The term "heads 41" will be used when referring to these heads as a whole.

Each of the heads 41 has four nozzle arrays. Each nozzle array has 180 nozzles arranged at 180-dpi intervals. The nozzle arrays are displaced relative to each other by 720 dpi in the sheet-width direction (orthogonal to the transporting direction). This displacement allows for image formation at a resolution of 720 dpi in the sheet-width direction.

Structure of Heads

Figure 4:
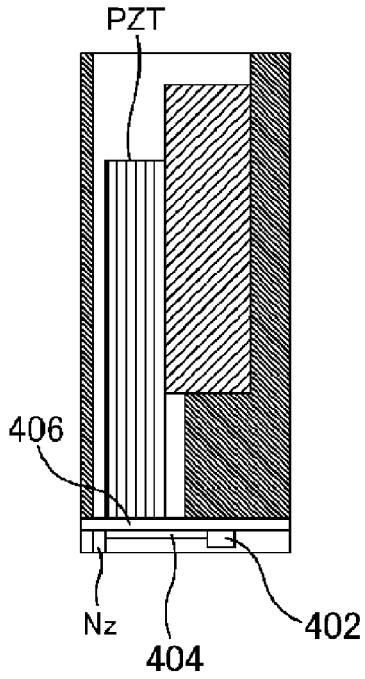
FIG. 4 illustrates the structure of one of the heads.

FIG. 4 illustrates the structure of one of the heads 41. FIG. 4 shows a nozzle Nz, a piezoelectric element PZT, an ink supply channel 402, a nozzle communication channel 404, and an elastic plate 406.

The ink supply channel 402 is supplied with ink from the ink tank 42. The ink is then supplied to the nozzle communication channel 404. A drive pulse to be described hereinafter is applied to the piezoelectric element PZT. When a drive pulse is applied to the piezoelectric element PZT, the piezoelectric element PZT contracts in accordance with the signal of the drive pulse, thereby vibrating the elastic plate 406. As a result, an amount of liquid droplet corresponding to the amplitude of the drive pulse is ejected from the nozzle Nz.

Driving Signal

Figure 5:
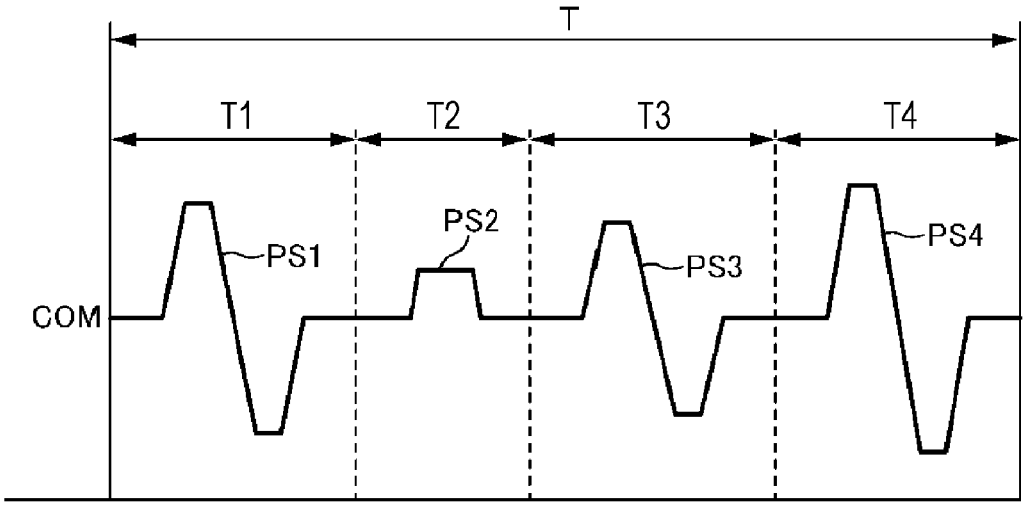
FIG. 5 is a diagram for explaining a driving signal.

FIG. 5 is a diagram for explaining a driving signal. As shown in FIG. 5, a driving signal COM is generated repetitively for every repetitive cycle T. The driving signal COM includes a drive pulse PS1 in a period T1, a drive pulse PS2 in a period T2, a drive pulse PS3 in a period T3, and a drive pulse PS4 in a period T4. When a drive pulse PS1 is applied to the piezoelectric element PZT of a head 41, a liquid droplet for forming a medium dot is ejected. When a drive pulse PS2 is applied to the piezoelectric element PZT, a meniscus (i.e. a free surface of ink exposed from the nozzle) is micro-vibrated. When a drive pulse PS3 is applied to the piezoelectric element PZT, a liquid droplet for forming a small dot is ejected. When a drive pulse PS4 is applied to the piezoelectric element PZT, a liquid droplet for forming a large dot is ejected.

These drive pulses are selectively applied to the piezoelectric element PZT in accordance with the control by the controller 60 and are used for forming dots on pixels on a sheet.

Reference Example where Low-Viscosity Ink is Used

Figure 6:
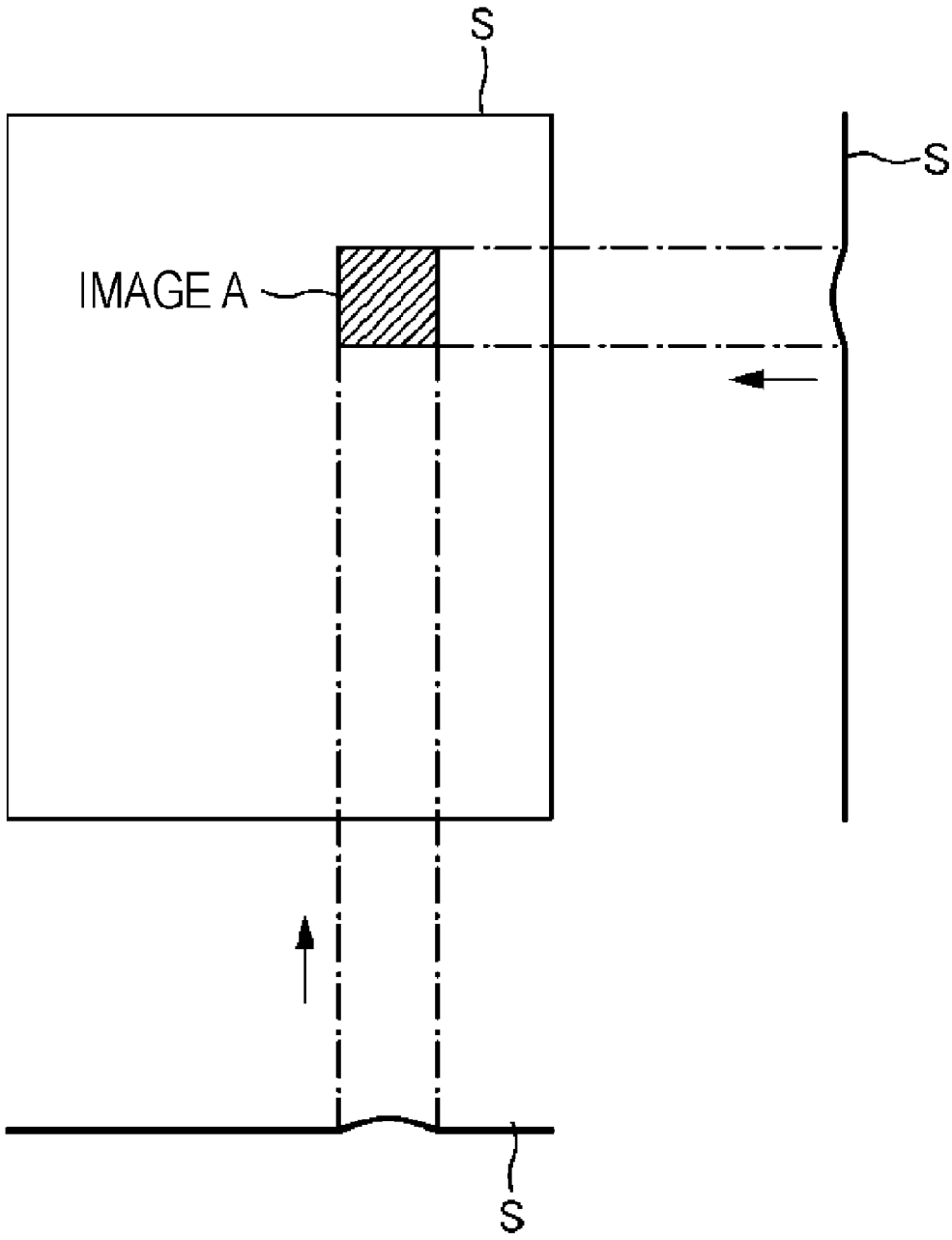
FIG. 6 illustrates a cockling phenomenon.

FIG. 6 illustrates a so-called cockling phenomenon. FIG. 6 shows a sheet S, and also has a side view and a bottom view of the sheet S. An image A is formed in a certain area of the sheet S. To explain the cockling phenomenon, the image A is printed with a large amount of liquid per unit area. For example, the image A is formed by printing at high density as in solid printing.

When such printing is performed, a large amount of ink droplets will adhere to the region of the image A. This causes the fibers of the sheet S to absorb the moisture of the ink droplets and thus expand. On the other hand, since such expansion of the fibers does not occur in the remaining regions, the region with the ink droplets becomes deformed and swollen as compared to the remaining regions. As a result, the sheet S wrinkles. This phenomenon is called a "cockling phenomenon".

Figure 7A:
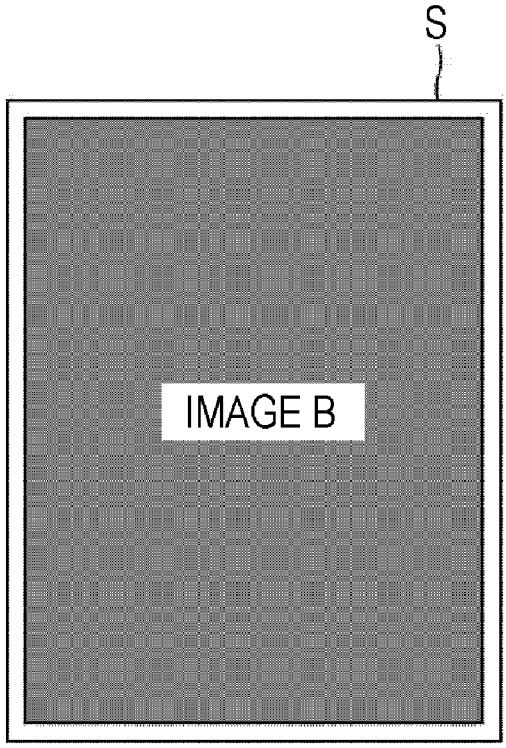
FIG. 7A illustrates an image that causes a curl phenomenon.

FIG. 7A illustrates an image that causes a curl phenomenon. The following description will be directed to a case where an image is formed only on one face (front face) of a sheet. FIG. 7A shows a sheet S and an image B occupying a large area of the sheet S. To explain the curl phenomenon, the image B is printed with a large amount of liquid per unit area. For example, the image B is formed by printing at high density as in solid printing.

Similar to the above, when such printing is performed, a large amount of ink droplets will adhere to the region of the image B. This causes the fibers of the sheet S to absorb the moisture of the ink droplets and thus expand. In this case, a large amount of ink droplets adheres to the front face of the sheet S, causing the fibers at the front face to expand. The image B is a kind of image that occupies the major area of the sheet S. Consequently, the expansion of the fibers in the region of the image B causes the entire sheet S to curl as if the front face thereof becomes the outer side of a circle.

Figure 7B:
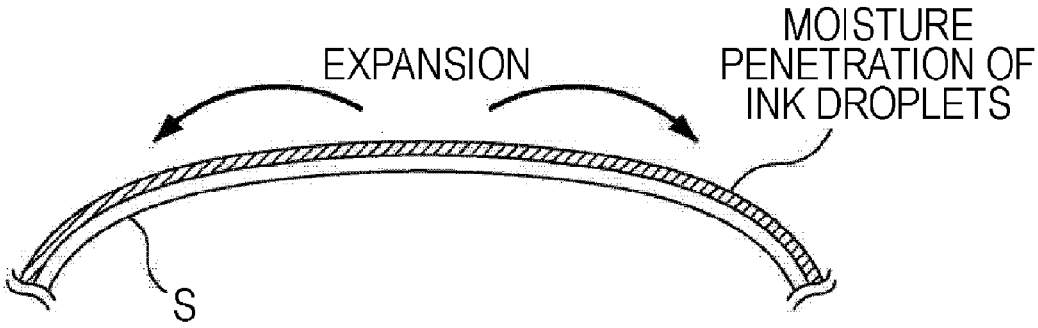
FIG. 7B is a diagram for explaining the principles of occurrence of a curl phenomenon.

FIG. 7B is a diagram for explaining the principles of occurrence of a curl phenomenon. As is apparent from FIG. 7B, the fibers at the front face of the sheet S expand and thus stretch the front face, causing the sheet S to curl.

This deformation of the sheet S occurs as a result of the moisture contained in ink penetrating the sheet S. Therefore, such deformation is notable when the ink used has a large amount of moisture and low viscosity. Accordingly, by using high-viscosity ink to minimize the penetration of the moisture contained in the ink into the sheet S, the occurrence of such deformation can be minimized.

Figure 8:
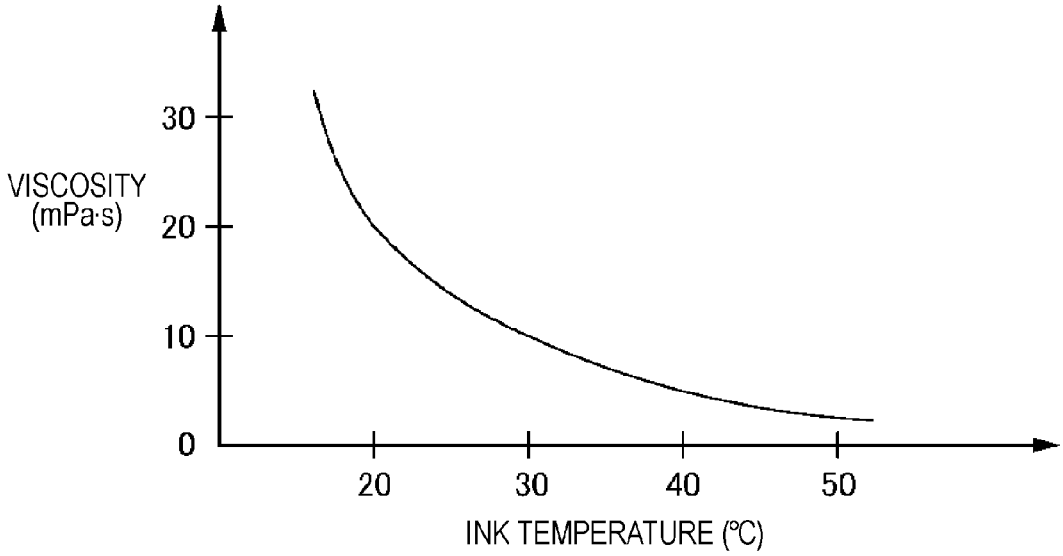
FIG. 8 illustrates an example of a graph showing characteristics of high-viscosity ink.

FIG. 8 illustrates an example of a graph showing characteristics of high-viscosity ink. The high-viscosity ink shown has a viscosity of 20 mPa·s when the ink temperature is 20° C. and a viscosity of 5 mPa·s when the ink temperature is 40° C.

A high-viscosity ink can be made by giving a solvent a large proportion of, for example, glycerine with respect to water, or by increasing the content of coloring material. As an alternative, a high-viscosity ink can be made by adding a viscosity modifier such as rosin, alginic acid, polyvinyl alcohol, hydroxypropyl cellulose, carboxymethyl cellulose, hydroxyethyl cellulose, methyl cellulose, polyacrylic acid, polyvinyl pyrrolidone, or gum arabic. A high-viscosity ink is not limited to the above, and may alternatively be an ultraviolet ink, a hot-melt ink, or an oil-based ink.

A high-viscosity ink having the characteristics as shown in FIG. 8 has a viscosity of 20 mPa·s at normal temperature (20° C.), which is too high for ejecting ink droplets of an appropriate size from the nozzles of the head unit 40. In view of the diameter of the nozzle holes of the heads 41 in the head unit 40 and the drive capability of the piezoelectric elements PZT, the viscosity of ink is preferably 10 mPa·s or lower for ejection. It is more preferable that the ink be heated to 40° C. or higher to set the viscosity thereof to 5 mPa·s. In order to lower the viscosity of ink by heating the ink in this manner, the heater 30 for heating the ink can be positioned as follows.

Position of Heater 30 in Reference Example

Figure 9:
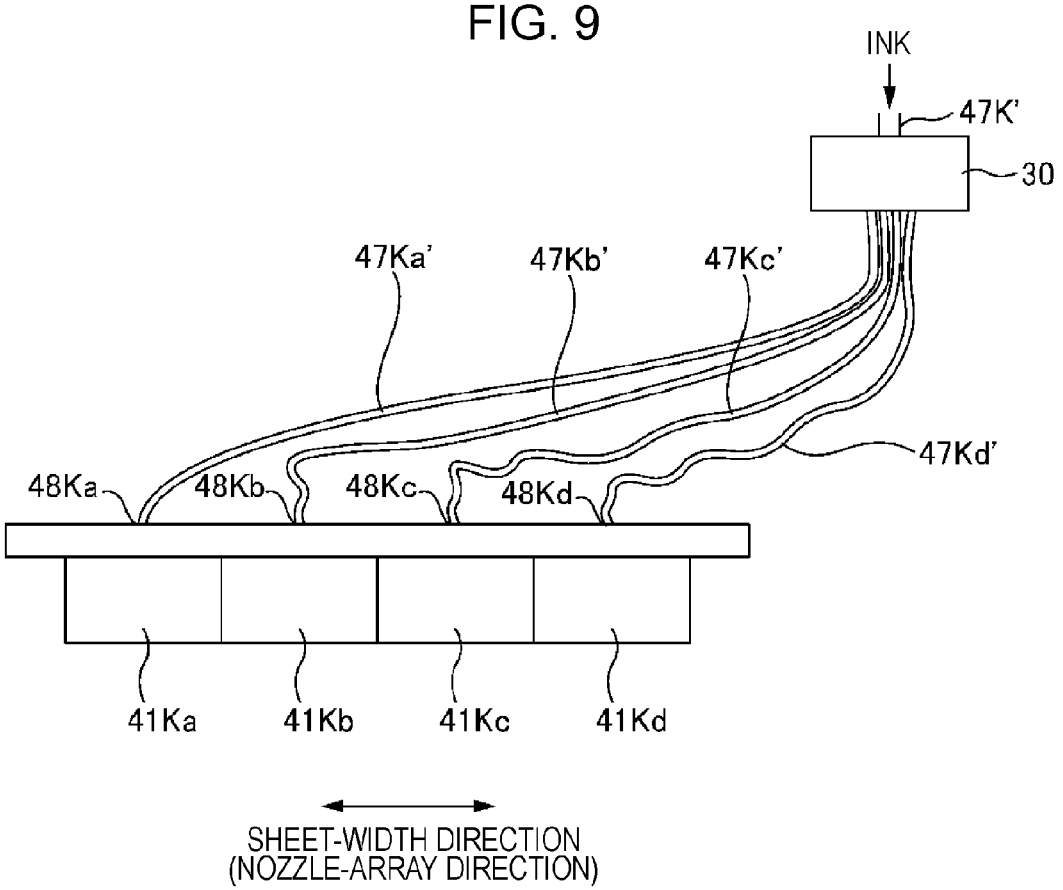
FIG. 9 is a diagram for explaining the position of a heater in the sheet-width direction according to a reference example.

FIG. 9 is a diagram for explaining the position of the heater 30 in the sheet-width direction according to a reference example. FIG. 9 shows the heads 41Ka to 41Kd of the black head unit 46K and the heater 30. FIG. 9 also shows the positions of ink supply ports 48Ka to 48Kd of the respective heads 41Ka to 41Kd and tubes 47Ka' to 47Kd' for supplying black ink to the respective heads 41Ka to 41Kd. Since this configuration similarly applies to those for the remaining colors, the description here will simply be directed to the configuration of the components for the black color K as a representative configuration.

A black ink is supplied through a tube 47K'. The heater 30 heats the ink flowing through the tube 47K'. The tube 47K' branches off into the four tubes 47Ka' to 47Kd', which respectively connect to the supply ports 48Ka to 48Kd of the heads 41Ka to 41Kd.

As viewed in the sheet-width direction in FIG. 9, the heater 30 is disposed to the right of the ink supply port 48Kd of the rightmost head 41Kd. Disposing the heater 30 to the right of the supply port 48Kd of the rightmost head 41Kd in the nozzle-array direction will cause the rightmost head 41Kd of the heads 41Ka to 41Kd to be located closest to the heater 30 and the leftmost head 41Ka to be located farthest from the heater 30, resulting in a notable difference in distance from the heater 30. Likewise, disposing the heater 30 to the left of the supply port 48Ka of the leftmost head 41Ka in the nozzle-array direction will cause the leftmost head 41Ka of the heads 41Ka to 41Kd to be located closest to the heater 30 and the rightmost head 41Kd to be located farthest from the heater 30, thus resulting in a notable difference in distance from the heater 30. Consequently, when the tubes 47Ka' to 47Kd' extending from the heater 30 for supplying ink to the respective heads 41Ka to 41Kd are arranged in this manner, the tubes 47Ka' to 47Kd' will significantly differ from one another in terms of their lengths.

When there are significant differences in the length of the tubes 47Ka' to 47Kd', the temperature of ink flowing through a longer tube is more affected by the outside air and will become lower as compared to that of ink flowing through a shorter tube. In other words, the temperature of the supplied ink will vary among the heads 41Ka to 41Kd. For example, in the case of FIG. 9, the temperature of the ink supplied to the head 41Ka will be lower than that of the ink supplied to the head 41Kd. The different temperatures of ink supplied to the heads 41Ka to 41Kd will cause the heads 41Ka to 41Kd to have ink with different viscosities. This leads to a problem where the ink droplets to be ejected vary in size among the heads 41Ka to 41Kd.

Supposing that all of the tubes are given the same length from the position of the heater 30 shown in FIG. 9 to the respective heads 41Ka to 41Kd, these tubes will all have the length of the longest tube. In that case, the ink flow channels extending from the heater 30 to the heads 41Ka to 41Kd will all have a great length. The ink droplets to be ejected are very small in size and the ink consumption is very small. Therefore, since the ink flows through the tubes at a slow rate, the time that takes for the ink to flow from the heater 30 to the heads 41Ka to 41Kd will become long. This is problematic in that the heated ink will be further cooled by the outside air before reaching the heads 41Ka to 41Kd. Moreover, with long tubes, it becomes difficult to estimate how much the ink will be cooled before reaching the heads 41Ka to 41Kd. This makes it difficult to set the viscosity of the ink to a desired viscosity level at the stage when the ink is supplied to the heads 41Ka to 41Kd, thus making it difficult for the heads 41Ka to 41Kd to eject ink droplets of an appropriate size.

In the following embodiment, the heater 30 is disposed at a position where the average distance from the heater 30 to the heads 41Ka to 41Kd can be minimized while the tubes can all be given substantially the same length.

Position of Heater 30 According to an Embodiment

Figure 10:
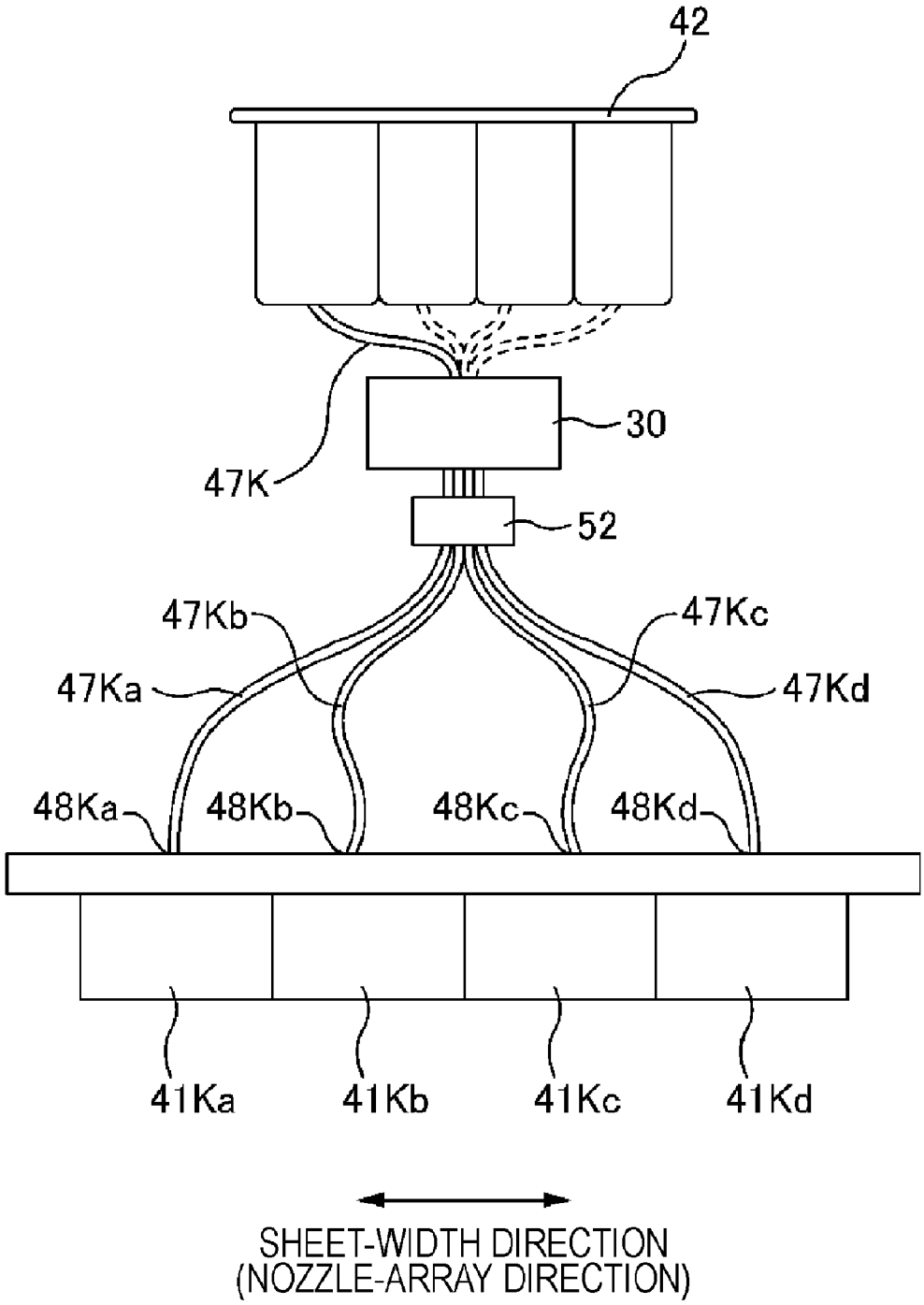
FIG. 10 is a diagram for explaining the position of the heater in the sheet-width direction according to an embodiment of the invention.

FIG. 10 is a diagram for explaining the position of the heater 30 in the sheet-width direction according to an embodiment of the invention. FIG. 10 shows the ink tank 42, the heater 30, and the temperature sensor 52. FIG. 10 also shows the heads 41Ka to 41Kd for ejecting black ink K and tubes 47Ka to 47Kd for supplying ink to the respective heads 41Ka to 41Kd. Since this configuration similarly applies to those for the remaining colors, the description here will simply be directed to the configuration of the components for the black color K as a representative configuration.

The ink tank 42 is for storing black K, cyan C, magenta M, and yellow Y inks. A flexible tube 47K for supplying black ink to the heads 41Ka to 41Kd is attached below a region of the ink tank 42 that stores black ink. Similarly, flexible tubes are attached below regions of the ink tank 42 that store the remaining color inks. Since the description here is directed to the configuration of the black head unit 46K, the tubes used for the color inks other than the tube for the black ink are indicated with chain lines. All of these tubes are bound together and inserted in the heater 30.

The heater 30 heats the ink flowing through the tube 47K to lower the viscosity of the ink. The heater 30 is connected to the controller 60 where the heating temperature of the heater 30 is controlled. The temperature sensor 52 is connected to tubes located downstream of the heater 30. The temperature sensor 52 is provided for detecting the temperature of ink heated by the heater 30. The temperature sensor 52 is connected to the controller 60, and sends information about the detected ink temperature to the controller 60. Based on this fed-back temperature information, the controller 60 is capable of controlling the heater 30 so as to adjust the ink temperature to a target temperature.

In this embodiment, the temperature is controlled so that the heads 41Ka to 41Kd can eject ink at 40° C. Consequently, in view of the tube length extending from the heater 30 to the heads 41, the heater 30 is controlled so that the target temperature is 42° C. at the location of the temperature sensor 52.

The tube 47K extending from the heater 30 towards the heads 41Ka to 41Kd via the temperature sensor 52 branches off into four tubes 47Ka to 47Kd at the heater 30 so that the ink can be supplied to the heads 41Ka to 41Kd, respectively. The branch tubes 47Ka to 47Kd are given the same length, and are respectively connected to the supply ports 48Ka to 48Kd of the heads 41Ka to 41Kd.

Although FIG. 10 only shows a state where the tube 47K has the four branch tubes for supplying black ink to the corresponding heads, there are branch tubes provided for the four color inks in actuality. This means that, although not entirely shown, the four tubes for the four respective colors have a total of 16 branch tubes. It is to be noted that the branching position may be located elsewhere as long as the tubes serving as ink supply channels between the heater 30 and the supply ports of the heads have the same length. Although the branching position of the tube 47K is located at the heater 30 in FIG. 10, the branching position may alternatively be located at, for example, the temperature sensor 52.

The heater 30 is disposed at a center position between the supply ports 48Ka and 48Kd of the respective heads 41Ka and 41Kd at opposite ends as viewed in the sheet-width direction (nozzle-array direction). By positioning the heater 30 in this manner, the length of the tubes 47Ka to 47Kd extending from the heater 30 to the ink supply ports 48Ka to 48Kd of the respective heads 41Ka to 41Kd can be minimized, while the tubes 47Ka to 47Kd can be given substantially the same length. Accordingly, this can reduce the differences in ink temperature among the heads 41Ka to 41Kd when the ink is supplied to the heads 41Ka to 41Kd, whereby the heads 41Ka to 41Kd can be supplied with ink having substantially the same viscosity.

Figure 11:
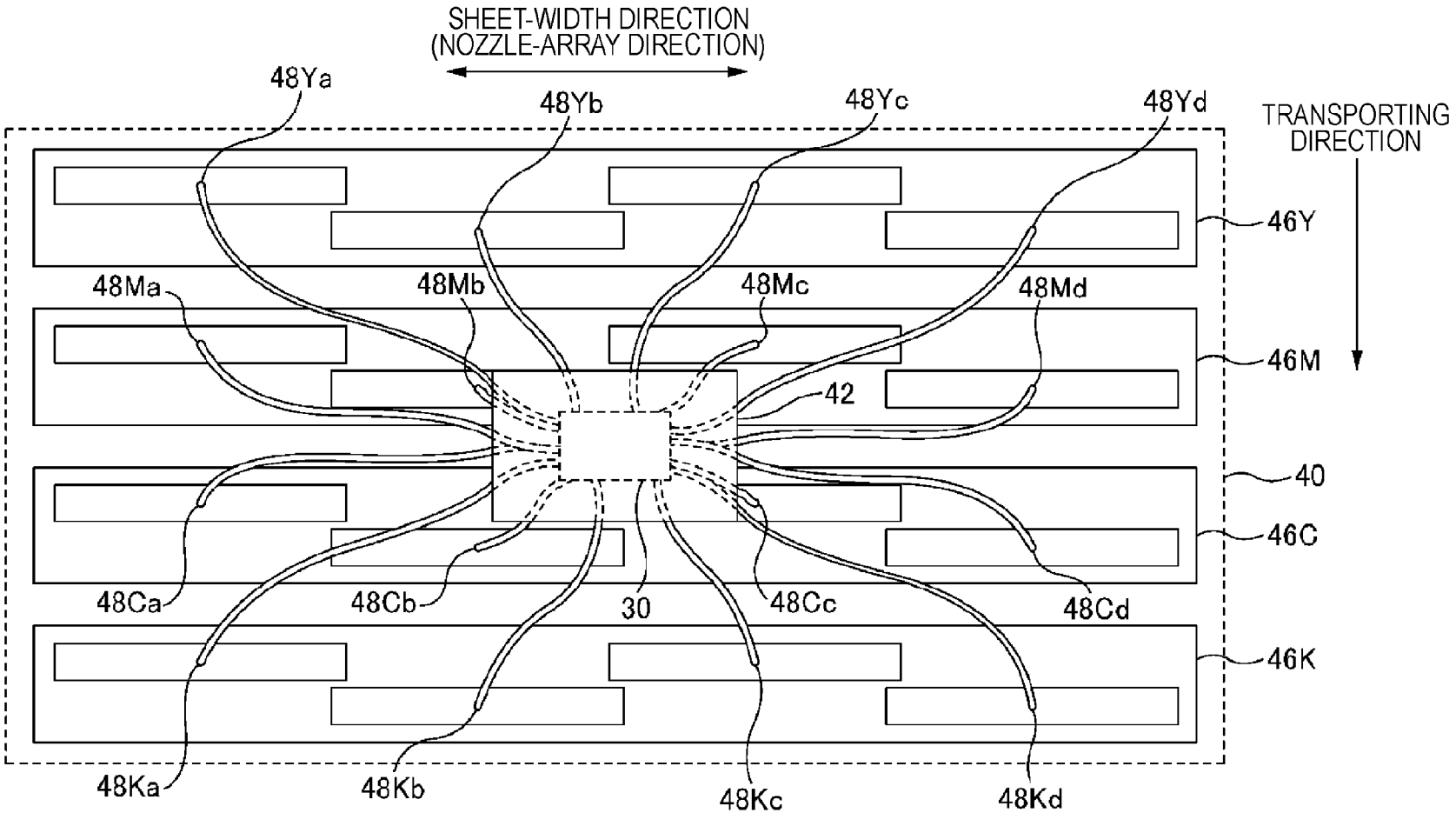
FIG. 11 is a diagram for explaining the position of the heater as viewed from above the printer.

FIG. 11 is a diagram for explaining the position of the heater 30 as viewed from above the printer 1. FIG. 11 shows the head unit 40 and the ink tank 42 disposed thereabove. FIG. 11 also shows ink supply ports 48Ya to 48Yd for the heads of the yellow head unit 46Y, ink supply ports 48Ma to 48Md for the heads of the magenta head unit 46M, ink supply ports 48Ca to 48Cd for the heads of the cyan head unit 46C, and ink supply ports 48Ka to 48Kd for the heads of the black head unit 46K. The heater 30 is not visible due to being covered by the ink tank 42 and is indicated with a chain line.

When viewed in the height direction, the heater 30 is disposed above the head unit 40. By disposing the heater 30 above the head unit 40 in this manner, the heater 30 can be disposed substantially at the center of the head unit 40 in the transporting direction and the width direction of a sheet S. Consequently, even if multiple head units (i.e. the yellow head unit 46Y, the magenta head unit 46M, the cyan head unit 46C, and the black head unit 46K) are arranged in the transporting direction as in FIG. 11 and a single heater 30 is used to heat the inks of all colors, the average length of the tubes extending from the heater 30 to the heads 41 for the respective colors can still be minimized, while the tubes can be given substantially the same length. This ability to minimize the length of the tubes while giving the tubes substantially the same length can contribute to reduced differences in ink temperature among the heads 41 when the ink is supplied to the heads.

Minimizing the length of the tubes extending from the heater 30 to the supply ports of the heads 41 while giving the tubes substantially the same length can be achieved simply by disposing the heater 30 at substantially the center of the head unit 40. An alternative configuration is also permissible where the ink tank 42 is disposed adjacent to the head unit 40 in the sheet-width direction and the ink is supplied from the ink tank 42 to the heater 30 through slightly long tubes.

Figure 12:
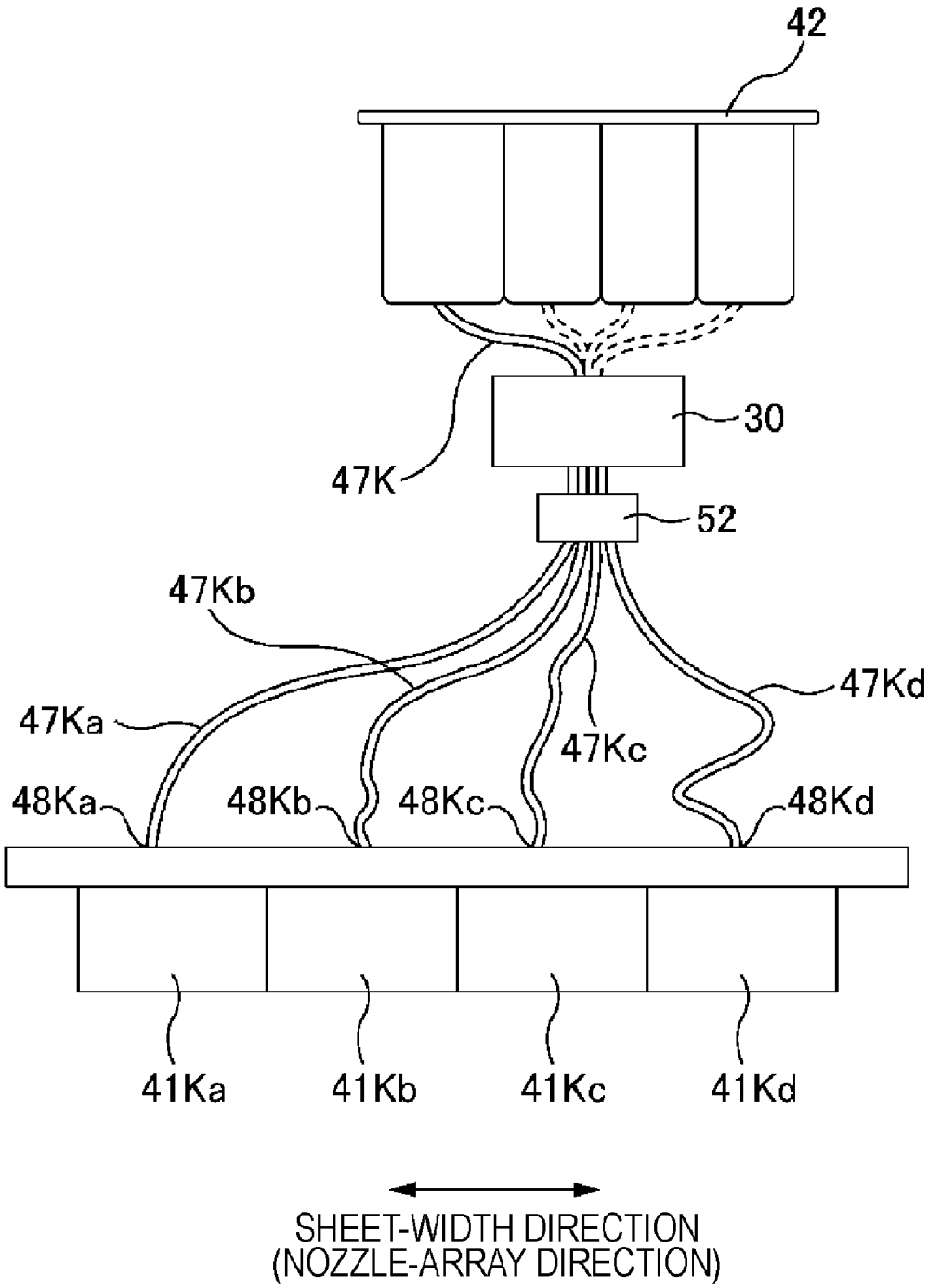
FIG. 12 is a diagram for explaining the position of the heater in the sheet-width direction according to another embodiment of the invention.

FIG. 12 is a diagram for explaining the position of the heater 30 in the sheet-width direction according to another embodiment of the invention. In FIG. 12, the heater 30 is not disposed at the center position between the leftmost supply port 48Ka and the rightmost supply port 48Kd, as viewed in the sheet-width direction. In other words, the heater 30 does not necessarily need to be disposed at the center position between the supply ports 48Ka and 48Kd of the respective heads 41Ka and 41Kd at opposite ends as long as the heater 30 is disposed in-between the two opposite-end supply ports 48Ka and 48Kd. It is apparent that differences in distance from the heater 30 to the supply ports 48Ka to 48Kd of the heads 41Ka to 41Kd will become greater as the heater 30 becomes positioned farther away from the center position of the opposite-end supply ports 48Ka and 48Kd in the sheet-width direction. However, as long as the heater 30 is positioned in-between the opposite-end supply ports 48Ka and 48Kd, the tubes can be considered that they have lengths that will not cause significant differences in ink temperature among the heads 41Ka to 41Kd before the ink reaches the heads 41Ka to 41Kd.

Figure 13:
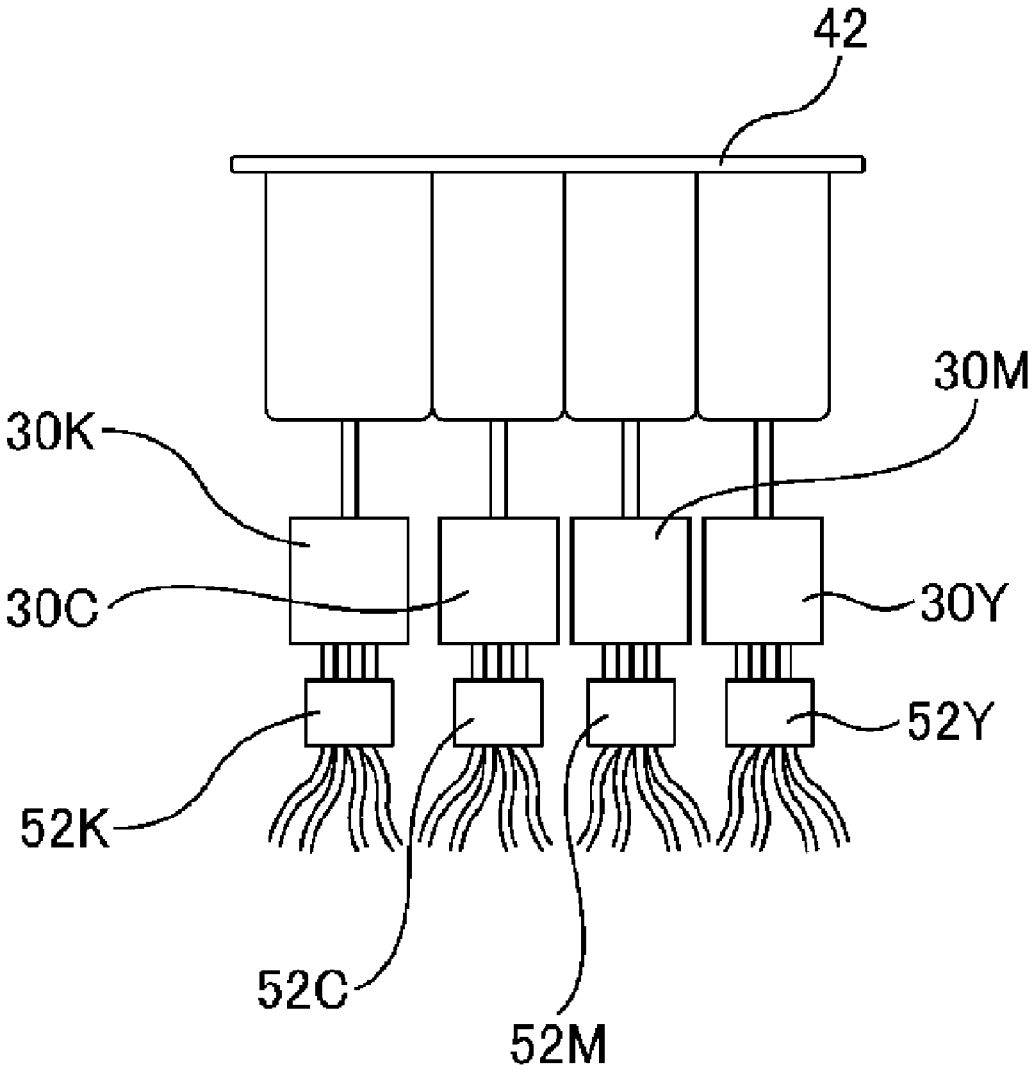
FIG. 13 shows an example where heaters are attached to tubes for respective color inks.

FIG. 13 shows an example where heaters are attached to the tubes for the respective color inks. As shown in FIG. 13, the tubes extending from below the regions of the ink tank 42 that store the respective color inks may individually have heaters 30 and temperature sensors 52 attached thereto. In that case, it is preferable that heaters 30K to 30Y are all disposed in-between the supply ports of the heads located at opposite ends in the sheet-width direction.

In image printing, there are certain color inks that are used more than others. An ink with more usage amount than others takes a shorter time to reach the corresponding heads 41 after being heated by the heater 30, which implies that the time in which the ink is cooled by the outside air is shorter. On the other hand, an ink with less usage amount than others takes a longer time to reach the corresponding heads 41 after being heated by the heater 30, which implies that the time in which the ink is cooled by the outside air is longer. Consequently, a temperature change that occurs before the inks reach the corresponding heads 41 varies among the different color inks.

Accordingly, in this example, the tubes for the respective color inks each have attached thereto a heater and a temperature sensor. The heaters are controlled to set the temperature of an ink with a small usage amount higher than that of an ink with a large usage amount, so that all of the color inks will be at substantially the same temperature when reaching the heads. For example, when an image that requires a large amount of black ink is to be printed, the heaters are controlled so that the target temperatures for the remaining color inks are set to higher values than that for the black ink. In this manner, the inks can be ejected from the corresponding heads at a suitable viscosity.

Figure 14:
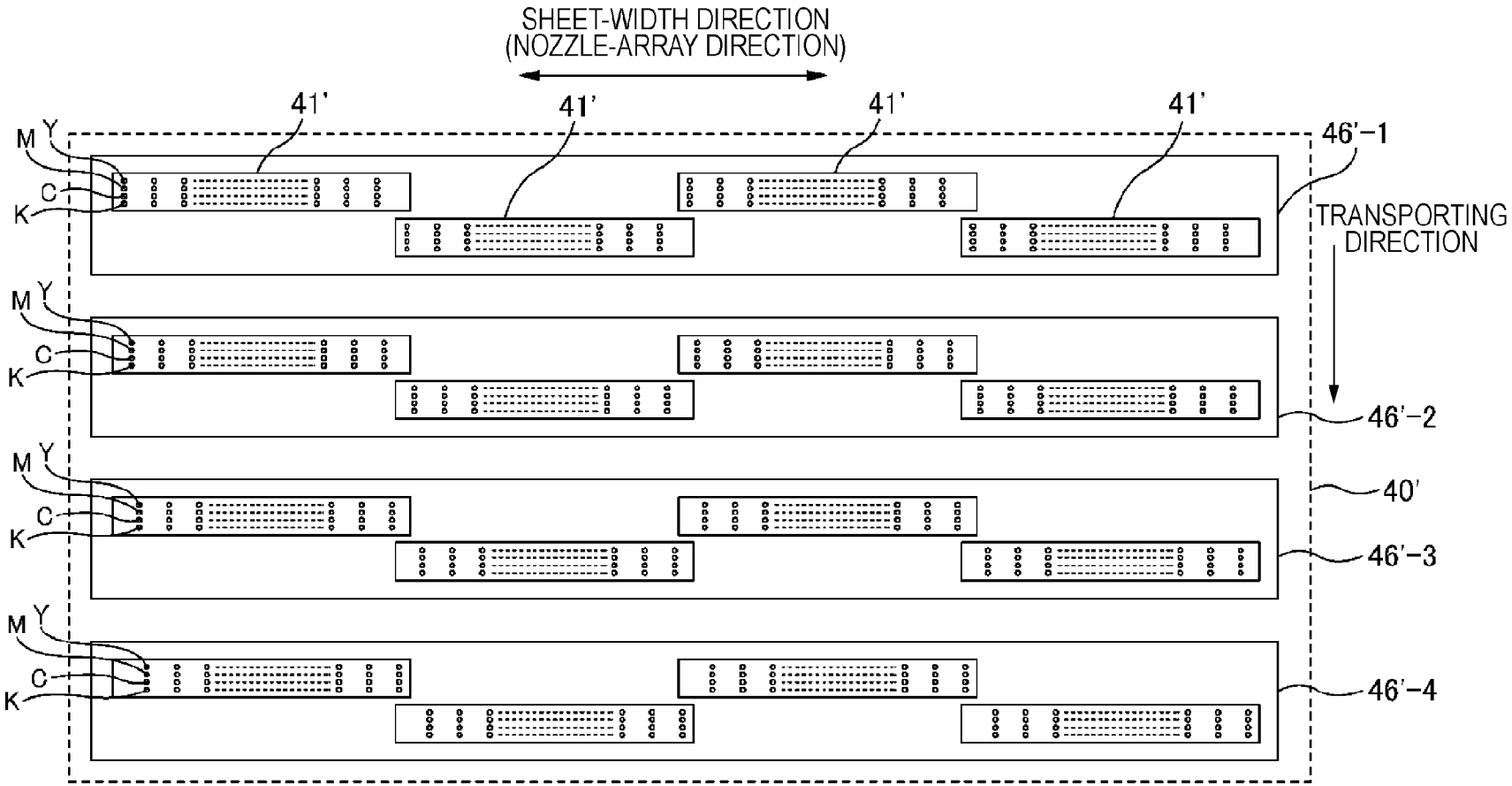
FIG. 14 is a diagram for explaining the arrangement of heads included in a head unit according to a modified example.

FIG. 14 is a diagram for explaining the arrangement of heads included in a head unit 40' according to a modified example. FIG. 14 is shown as viewed from above the printer 1. In actuality, the nozzle holes of the heads are not visible from above due to being covered by other components. However, the nozzle holes in FIG. 14 are shown as viewed from above for the sake of convenience.

The head unit 40 includes first to fourth head units 46'-1 to 46'-4. Each head unit includes heads 41'. Each head 41' has a yellow nozzle array Y, a magenta nozzle array M, a cyan nozzle array C, and a black nozzle array K. Each nozzle array has 180 nozzles arranged at 180 dpi intervals.

The nozzles of the nozzle arrays included in the second head unit 46'-2 are displaced relative to the nozzles of the nozzle arrays included in the first head unit 46'-1 by 720 dpi in the sheet-width direction. Similarly, the nozzles of the nozzle arrays included in the third head unit 46'-3 are displaced relative to the nozzles of the nozzle arrays included in the second head unit 46'-2 by 720 dpi in the sheet-width direction. Moreover, the nozzles of the nozzle arrays included in the fourth head unit 46'-4 are displaced relative to the nozzles of the nozzle arrays included in the third head unit 46'-3 by 720 dpi in the sheet-width direction. Such displacement allows for image formation at a resolution of 720 dpi in the sheet-width direction.

Figure 15:
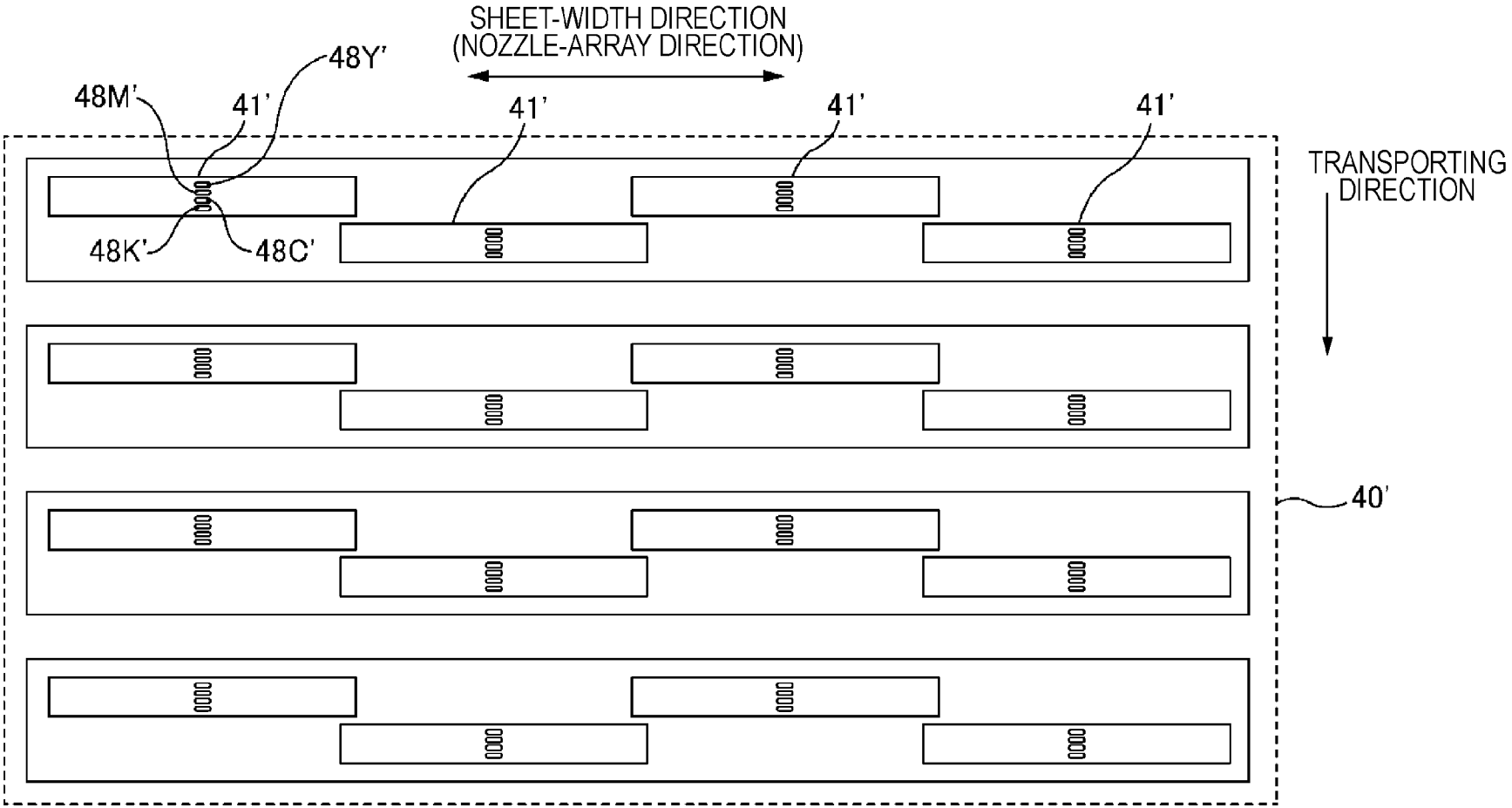
FIG. 15 is a diagram for explaining supply ports of the heads in the head unit according to the modified example.

FIG. 15 is a diagram for explaining the supply ports of the heads in the head unit 40' according to the modified example. When the head unit 40' as shown in FIG. 14 is used, each of the heads 41' is supplied with four color inks. In this case, as shown in FIG. 15, each head 41' requires four supply ports.

As in the above embodiments, the heater 30 can be disposed substantially at the center of the head unit 40' in the transporting direction and in-between (preferably in the center of) the supply ports of the heads located at opposite ends in the sheet-width direction. Thus, even with the heads having the configuration according to this modified example, the length of the tubes extending from the heater 30 to supply ports 48Y', 48M', 48C', and 48K' of the respective heads 41' can be minimized, while the tubes can be given substantially the same length. Accordingly, this can reduce the differences in ink temperature among the heads when the ink is supplied to the heads.

Other Embodiments

The viscosity of ink as described above is relative to the ink ejecting capability of each head. Therefore, the viscosity with respect to a specific temperature is not limited to that described above.

An "image" in this embodiment is not limited to an image to be formed on a sheet and may include a pattern to be used in, for example, a semiconductor manufacturing process. Furthermore, the above-described technology is applicable not only to a printing method in which printing is performed by ejecting ink onto paper, but also to various industrial apparatuses. One major example is a printing apparatus (method) for printing patterns onto textiles.

The above embodiments are for providing an easier understanding of the invention but are not intended for limiting the invention. The invention permits modifications to an extent that they do not depart from the scope of the invention, and may include equivalents thereof. In particular, the invention can include the following embodiment.

Heads

Although piezoelectric elements are used for ejecting ink in the above embodiments, the method for ejecting liquid is not limited and other methods may be applied, such as generating a bubble inside a nozzle by heat.

Conclusion

The following description of a conclusion is directed to the configuration of the components for the black color K as a representative configuration, but the configuration similarly applies to those for the remaining colors.

1. The printer 1 serving as a liquid ejecting apparatus in the above embodiments is equipped with the black head unit 46K having the heads 41Ka to 41Kd that are provided with ink supply ports 48Ka to 48Kd and are arranged in the nozzle-array direction for forming images by ink ejection. The printer 1 has the heater 30 for heating ink to be supplied to the head group (heads 41Ka to 41Kd), the heater 30 being disposed in-between the opposite-end ink supply ports 48Ka and 48Kd in the nozzle-array direction.

In this manner, the heater 30 can be disposed at a position averagely close to the ink supply ports of the heads. Thus, the length of the tubes extending from the heater 30 to the ink supply ports of the respective heads can be minimized, while the tubes can be given substantially the same length from the heater 30 to the respective supply ports. This ability to minimize the length of the tubes while giving the tubes substantially the same length can contribute to reduced differences in ink temperature among the heads 41Ka to 41Kd when the ink is supplied to the heads, whereby the heads can be supplied with ink having substantially the same viscosity. Thus, the ink droplets to be ejected can be made equal in size among the heads 41Ka to 41Kd, thereby enhancing the image quality.

2. Furthermore, the heater 30 is disposed at the center position between the supply ports 48Ka and 48Kd of the respective opposite-end heads 41Ka and 41Kd in the nozzle-array direction.

In this manner, the heater 30 can be disposed at a position averagely close to the ink supply ports of the heads. Thus, the length of the tubes extending from the heater 30 to the ink supply ports of the respective heads can be minimized, while the tubes can be given substantially the same length from the heater 30 to the respective supply ports. This ability to minimize the length of the tubes while giving the tubes substantially the same length can contribute to reduced differences in ink temperature among the heads 41Ka to 41Kd when the ink is supplied to the heads.

3. The heater 30 is attached to the tube 47K that branches off into branch tubes 47Ka to 47Kd from the heater 30, the branch tubes 47Ka to 47Kd supplying ink to the heads 41 through the respective supply ports 48Ka to 48Kd.

In this manner, the ink to be supplied to the heads 41Ka to 41Kd by flowing through the tubes 47Ka to 47Kd can be heated by the heater 30. Thus, the viscosity of high-viscosity ink can be lowered before the ink is supplied to the heads 41Ka to 41Kd.

4. The branch tubes 47Ka to 47Kd extending from the heater 30 to the respective heads 41Ka to 41Kd have the same length.

This can reduce the differences in temperature of ink to be supplied to the heads 41Ka to 41Kd, thereby supplying the heads with ink having substantially the same viscosity. Thus, the ink droplets to be ejected can be made equal in size among the heads 41Ka to 41Kd, thereby enhancing the image quality.

5. The heater 30 is disposed at a position higher than that of the head group (head unit 40).

Consequently, even if multiple heads are arranged in the transporting direction of a sheet S and a single heater 30 is used to heat the inks of all colors, the average length of the tubes extending from the heater 30 to the heads 41 for the respective colors can still be minimized, while the tubes can be given substantially the same length. This ability to minimize the length of the tubes while giving the tubes substantially the same length can contribute to reduced differences in ink temperature among the heads 41 when the ink is supplied to the heads.

6. The printer 1 also includes the temperature sensor 52 that acquires temperature information about the temperature of ink, and the controller 60 that controls the heater 30 based on the temperature information to control the temperature of ink to be supplied to the heads 41.

In this manner, the temperature of ink to be supplied to the heads 41 can be controlled. By setting the ink to a desired temperature, an appropriate ink viscosity can be achieved.

7. The temperature sensor 52 is attached to the tubes used for supplying ink to the heads 41, the tubes being located downstream of the heater 30.

Accordingly, the ink temperature can be controlled on the basis of the temperature of ink heated by the heater 30.

8. The viscosity of ink at 25° C. is 10 mPa·s or higher.

Accordingly, when a generally so-called high-viscosity ink whose viscosity at 25° C. is 10 mPa·s or higher is used, the ink can be heated by the heater 30 so that the viscosity of the ink is lowered before the ink is supplied to the heads 41. Thus, the ink droplets to be ejected from the heads 41 can be made equal in size.

9. The temperature of ink is controlled to 30° C. or higher for ejection.

Accordingly, when a generally so-called high-viscosity ink is used, the ink can be heated to 30° C. or higher so that the viscosity of the ink is lowered before the ink is supplied to the heads 41. Thus, the ink droplets to be ejected from the heads 41 can be made equal in size.

10. It is a matter of course that there is a liquid ejecting method as follows. Specifically, in this liquid ejecting method, the ink to be supplied to the heads 41 is heated by the heater 30 disposed between the ink supply ports 48Ka and 48Kd of the respective opposite-end heads 41Ka and 41 Kd of the multiple heads 41 arranged in the nozzle-array direction. Subsequently, the heads 41 receiving the ink eject the ink so as to form an image.

Accordingly, the length of the tubes extending from the heater 30 to the heads 41 can be minimized, while the tubes can be given substantially the same length. This ability to minimize the length of the tubes while giving the tubes substantially the same length can contribute to reduced differences in ink temperature among the heads 41 when the ink is supplied to the heads, whereby the heads can be supplied with ink having substantially the same viscosity. Thus, the ink droplets to be ejected can be made equal in size among the heads, thereby enhancing the image quality.

11. Furthermore, it is a matter of course that there is a program that allows the aforementioned liquid ejecting apparatus to perform the aforementioned liquid ejecting method.

What is claimed is:

1. A liquid ejecting apparatus comprising:

a head group having a plurality of heads provided with supply ports for supplying liquid to the heads, the heads being arranged in a nozzle-array direction and ejecting the liquid therefrom to form an image; and a single heating portion that heats the liquid to be supplied to each of the plurality of heads, the heating portion being disposed between the supply ports of the heads located at opposite ends of the head group in the nozzle-array direction, wherein the single heating portion is attached to a tube that branches off into branch tubes from the heating portion, the branch tubes supplying the liquid to the heads through the supply ports.

2. The liquid ejecting apparatus according to claim 1, wherein the heating portion is disposed at a center position between the supply ports of the opposite-end heads in the nozzle-array direction.

3. The liquid ejecting apparatus according to claim 1, wherein the branch tubes extending from the heating portion to the corresponding heads have the same length.

4. The liquid ejecting apparatus according to claim 1, wherein the heating portion is disposed at a position higher than that of the head group.

5. The liquid ejecting apparatus according to claim 1, further comprising:

a temperature acquiring portion that acquires temperature information about temperature of the liquid; and a temperature controlling portion that controls the heating portion on the basis of the temperature information so as to control the temperature of the liquid to be supplied to the heads.

6. The liquid ejecting apparatus according to claim 5, wherein the temperature acquiring portion is attached to a tube located downstream of the heating portion, the tube supplying the liquid to the heads.

7. The liquid ejecting apparatus according to claim 1, wherein the liquid has a viscosity of 10 mPas or higher at 25° C.

8. The liquid ejecting apparatus according to claim 1, wherein the liquid is controlled to a temperature of 30° C. or higher for ejection.

* * * * *